United States Patent [19]

Ashman, Jr.

[11] 3,976,048

[45] Aug. 24, 1976

[54] FIREPLACE STRUCTURE

[76] Inventor: Robert G. Ashman, Jr., Pine Tree Drive, Plainville, Mass. 02762

[22] Filed: Sept. 16, 1974

[21] Appl. No.: 506,456

[52] U.S. Cl. ..... 126/143; 126/140; 126/202

[51] Int. Cl.[2] ..... F24B 13/02; F24B 1/18

[58] Field of Search ..... 126/143, 202, 140

[56] References Cited

UNITED STATES PATENTS

| | | | |
|---|---|---|---|
| 2,470,430 | 5/1949 | Carter | 126/143 |
| 2,776,707 | 1/1957 | Helwig | 126/202 X |
| 2,819,711 | 1/1958 | Robinson | 126/143 |
| 3,616,788 | 11/1971 | Hannebaum | 126/140 X |
| 3,845,754 | 11/1974 | Wilkening | 126/121 |

FOREIGN PATENTS OR APPLICATIONS

| | | | |
|---|---|---|---|
| 28,089 | 12/1909 | United Kingdom | 126/143 |
| 651,856 | 4/1951 | United Kingdom | 126/143 |

*Primary Examiner*—William F. O'Dea
*Assistant Examiner*—Harold Joyce
*Attorney, Agent, or Firm*—Barlow & Barlow

[57] ABSTRACT

A draft control means is provided for a fireplace structure in which a firebox is provided, which firebox forms a heat generating chamber. The specific improvement provides outside air induction into the firebox proper so as not to rob the room being heated from air which would normally go up the flue.

6 Claims, 9 Drawing Figures

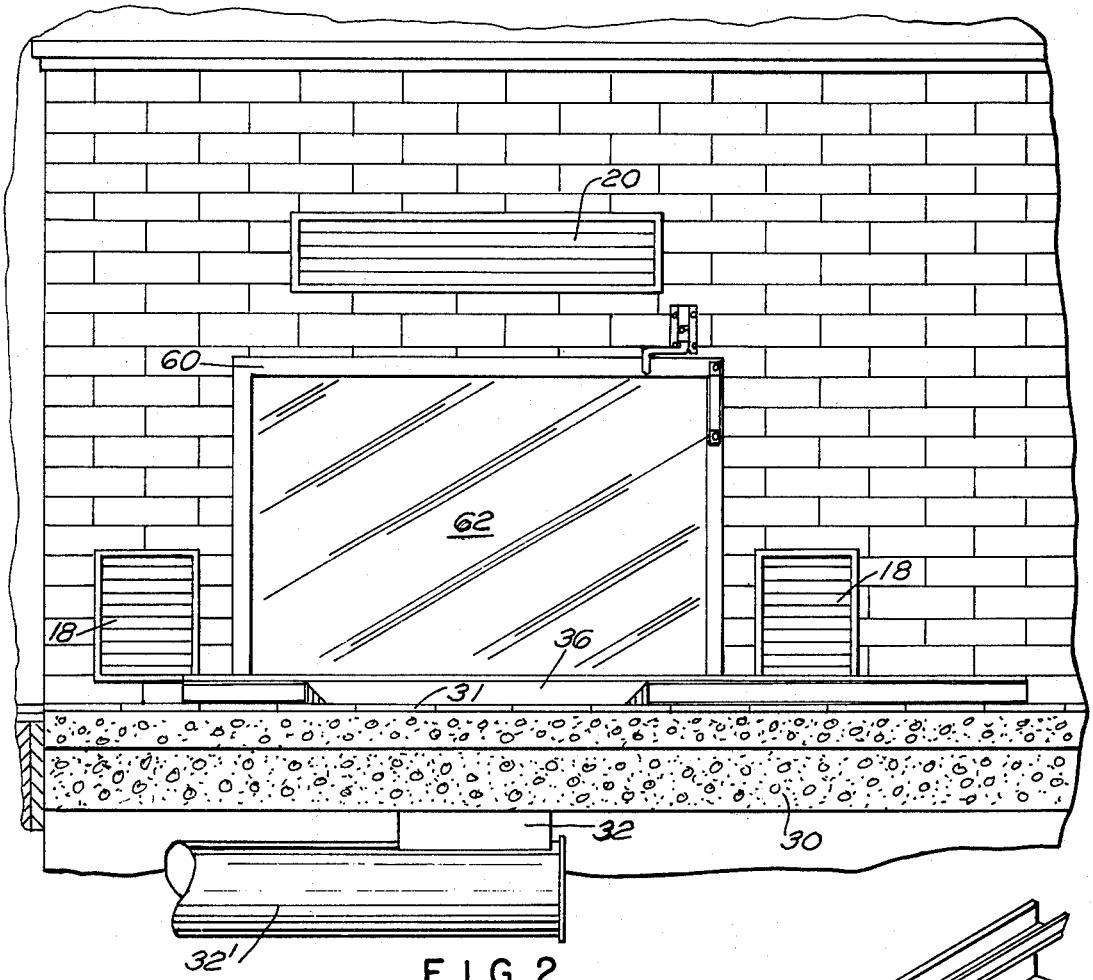
FIG. 2
FIG. 8
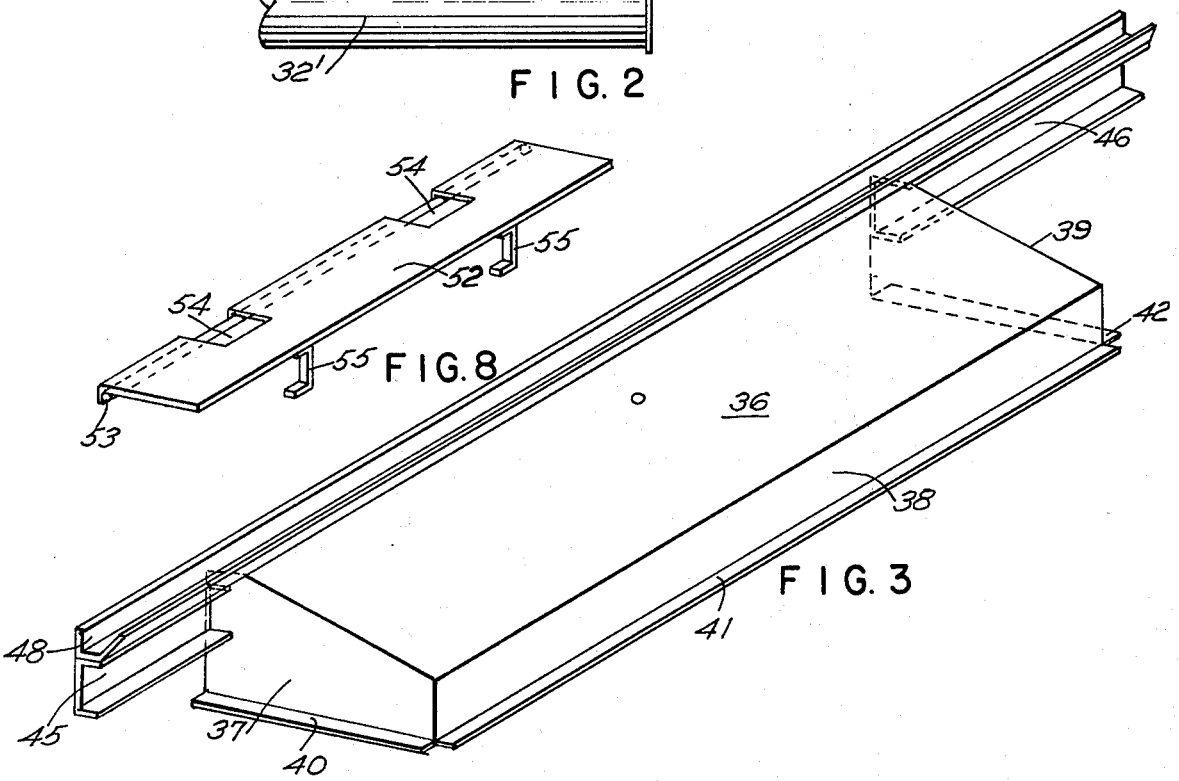
FIG. 3

FIREPLACE STRUCTURE

BACKGROUND OF THE INVENTION

This invention relates to fireplace structures in general and in particular either a space heater type or direct radiation masonry fireplace or one in which a fireplace heater unit develops heated air to be re-circulated within a room. Various types of fireplace units of this latter type are known and consist essentially of a firebox with surrounding duct work as shown, for example, in the Libbey U.S. Pat. No. 438,319. In fireplaces of this type or of the space heater type, as exemplified by Derringer et al. U.S. Pat. No. 3,654,913, a considerable amount of room air is used to support combustion within the combustion chamber. This air is supplied by the room in which the unit is located and any adjacent rooms can create drafts within the room since the natural convection of a burning fire draws air into the firebox and thence up the flue. Drafts are uncomfortable for one drawing benefit from the heat generator such as a space heater or fireplace, and the only prior recognition of this problem is in the Hoffman U.S. Pat. No. 2,863,443. The Hoffman patent which is concerned with a stove insert into a masonry structure provides a direct opening underneath the firebox where ashes can directly fall and clog the inlet. It is not completely satisfactory due to the location of the air inlet source.

SUMMARY OF THE INVENTION

This invention is directed to an improvement in a heating system where the fuel in the fireplace is more efficiently utilized by the introduction of fresh air into the firebox from the outside and the air in the room is not utilized in any way to support combustion. It is a well known fact that a fire draws air out of the room to support combustion and the vacuum that is developed due to the heated air rising out the flue draws air which is usually cold air into the room at any available opening. So much cold air comes into the room which is provided with a burning fireplace, that it causes a chilly feeling. Accordingly, the principal object of this invention is to supply a continuous flow of fresh outside air to the firebox sufficient to supply the entire demand of the fire in the fireplace which results in providing good draft conditions for the fireplace fire and a good circulation of air within the room to be heated.

Specifically the invention relates to a heating structure which could be a fireplace or a stove type unit having an upwardly directed flue with at least a structure defining an external housing with a firebox set into this external housing. In the illustrated form, there is a space between the wall of the firebox and the external structure to form a heating area with a plurality of passages around the firebox proper. Duct work is arranged to be led from the outside of the dwelling to an expander type of duct converter so that a narrow elongated delivery of air adjacent the bottom wall of the firebox for a substantial distance across the front of it is provided. To achieve complete control of the fire and to impede the flow of room air into the firebox proper, a screen in the form of a translucent screen is provided to be mounted across the front of the firebox and seal off the firebox itself from room air entering therein and yet also provide for some direct radiated heat to be transmitted therethrough.

DESCRIPTION OF THE DRAWINGS

FIG. 2 represents a front elevation of the fireplace partly in section and the duct work leading thereto;

FIG. 3 is a perspective view of the entrance hood to the firebox and the supporting rail for the firescreen;

FIG. 8 is a perspective view of a deflector that is used with deep fireplaces to insure that the air entering the base of the firebox is properly directed.

DESCRIPTION OF THE PREFERRED EMBODIMENT

Figure 1:
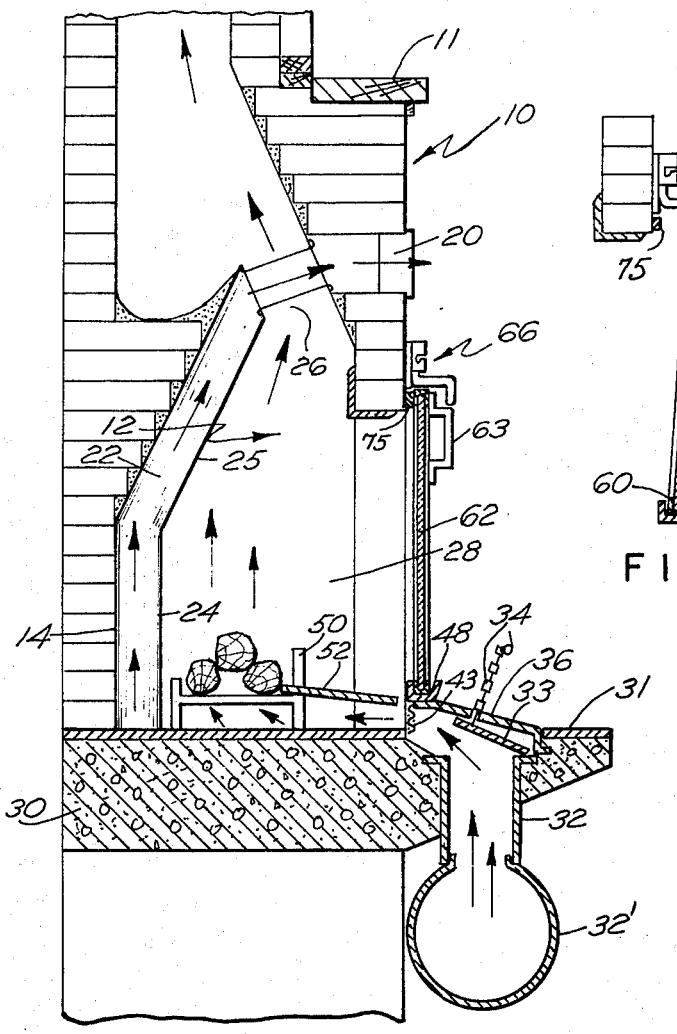
FIG. 1 is a vertical sectional view showing the invention arranged in a fireplace with ventilation duct work.

The numeral 10 indicates generally a masonry fireplace structure of usual form with certain decorative external construction as is customary such as a mantle 11 and the like. This masonry structure 10 is generally provided with a fireplace receiving space which may be generally indicated by the reference numeral 12 and into this space is fitted a metal fireplace unit which is usually of double-wall construction to provide passage between the walls for the circulation of air to be heated and delivered into the room. This fireplace unit may include a rear wall 14 and side walls (not shown) and will be provided with air inlet openings 18 near the bottom of the unit and at least one or more outlets such as 20 near the top of the unit. The inlets 18 and the outlets 20 are connected by duct work such as illustrated in FIG. 1 which is the result of the double-wall construction and ducts such as provided by the area 22 lead effectively from the inlets 18 to the outlets 20 around a firebox. The firebox is made from a back wall 24, a portion of the back wall as at 25 being inclined forwardly to a flue throat as at 26. The firebox additionally has side walls 28 which are spaced from the side walls of the main housing and this double-wall fireplace structure of this nature forms a hot air space or jacket such as 22 between the inner walls or firebox and outer walls or the housing itself. This particular part of the structure is well known to those skilled in the art and may take a plurality of forms. For example, the patent to Libbey U.S. Pat. No. 438,319 dated Oct. 14, 1890, and any number of later issued patents are exemplary of this general type of construction, the type illustrated herein being done purely for explaining the invention.

Fireplace or heating structures oftentimes are mounted on foundations such as the concrete foundation indicated at 30 and in the fireplace type are provided with a front hearth 31 which extends into the room. Passing upwardly through the foundation 30 and the hearth 31 is a duct 32 which may be provided with a suitable damper 33 adjusted by a stop chain 34 and which leads into an air deflector or distributor hood 36. This deflector (FIG. 3) is preferably made from sheet metal and has three side walls 37, 38 and 39 with suitable lips thereon extending about the bottom of the deflector which lips are designated 40, 41 and 42 and permit the same to be integrated into the masonry structure of the hearth. The open portion of the hood, as will be seen particularly in FIG. 1 is arranged to be immediately adjacent and just above the bottom wall of the firebox and may have a screen 43 extending across the opening so that ashes and other foreign matter will not enter the entry duct means. Since the deflector hood as illustrated does not completely cover the entire front opening of the firebox, extension pieces 45 and 46 laterally protrude from the side walls 37 and 39 respectively and have made integral therewith a continuous guide trough 48. The deflector hood may however extend completely across the firebox opening.

It is quite common in a firebox that is burning wood to utilize a grate 50 and to insure that the air coming from the deflector hood 36 goes to the under portion of the grate, it may, in many cases, be advantageous to utilize a deflector plate 52 which has a lip 53 that may hook on the grate. Apertures such as 54 may be cut to straddle any uprights on the grate device and support feet 55 are provided to hold the deflector 52 in proper position as diagrammed in FIG. 1.

Figure 5:
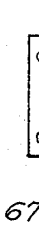
FIGS. 5, 6 and 7 are elevational, top and top diagrammatic views respectively illustrating the latch for the firescreen.
Figure 6:
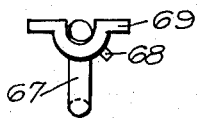
Figure 7:
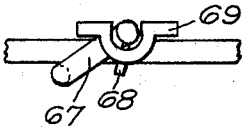
Figure 4:
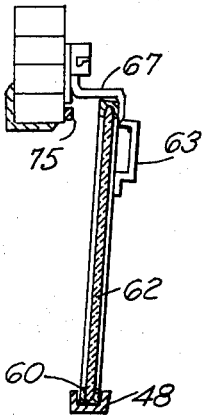
FIG. 4 represents a partial sectional view, somewhat diagrammatic in form, illustrating the manner in which the firescreen may be tilted away from the opening to the firebox.
Figure 9:
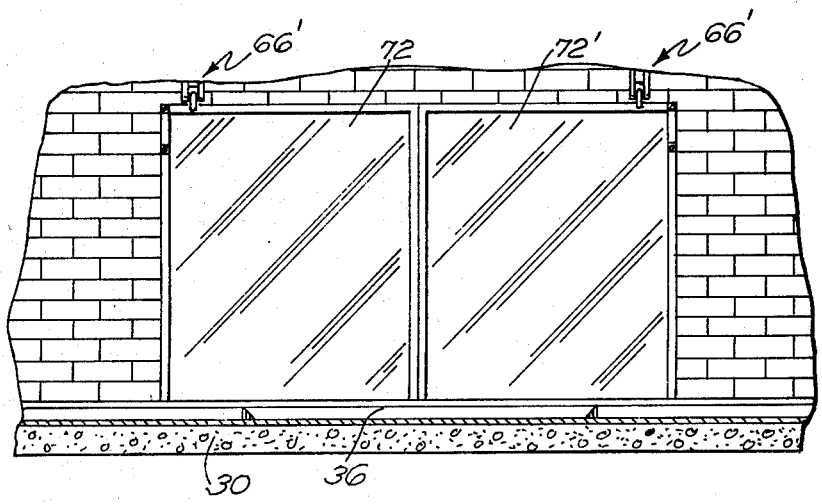
FIG. 9 is a partial front elevational view showing a two-part firescreen.

To seal off the front opening of the firebox and to insure proper operation of the invention, a translucent screen which may be heat resisting glass is provided. This screen comprises a metal frame 60 which embraces a sheet of glass 62 and the frame may be provided with a handle 63. It is basically adapted to fit into and slide along the trough 48. To keep the screen in place, a latch means generally designated 66 is provided which is shown in more detail in FIGS. 5, 6 and 7 of the drawings. This latch may consist of an L-shaped bar 67 with an operating pin 68 in the bar to be held for rotation and reciprocation in an apertured plate 69 which has a slot 70 through which the operator arm 68 may extend and drop into suitable locking at depressions therein. In some cases it is necessary to utilize from a size standpoint a pair of such screens and in this case a pair of screens 72, 72' are provided which have identical construction and may be slid in either direction on the trough 48, each screen being provided with a suitable latching device 66' (see FIG. 9). This particular latching device since the same may be pivoted permits the screen to rock forwardly in the trough 48 as illustrated in FIG. 4 and be held by the bar 67 in a rock forward position so that the screen may be slid in the trough 48. Gasket means 75 may be provided as a sealing device as well as a cushion for the screen, which in normal operation is pulled against the firebox opening.

It will be apparent that the inlet duct 32 has fitted therein a supply duct 32' that leads to a source of outside air outside of the building which is not illustrated as going outside of the building but htis feature would be well understood to those skilled in the art.

I claim:

1. In a fireplace having an upwardly directed flue, a structure having an external housing with rear and side walls, a firebox having top, side, rear and bottom walls with an open front set within the structure to form a heat generating chamber, a closure for said open front impeding air flow into said firebox, a hearth, a duct leading from a source of outside air to said hearth, a hood capping said duct comprising generally horizontally extending top wall and three side walls downwardly extending from said top wall and an open side adjacent and below said closure for generally horizontal passage of air from said duct to the firebox at a location adjacent and above and along the bottom wall of the firebox at the frontal portion thereof, means on said hood supporting said closure for sliding movement.

2. In a structure as in claim 1 said closure substantially closing the opening defined by the free edges of the top, side and bottom walls of the firebox.

3. In a structure as in claim 1 wherein the outlet of the hood extends substantially across the bottom wall of the firebox.

4. In a structure as in claim 2 wherein said closure includes a translucent screen.

5. In a structure as in claim 4 wherein said closure is supported at its lower edge by a trough for sliding movement therein and gasket means are provided about the edge thereof to seal the closure against the opening to the firebox.

6. In a structure as in claim 5 wherein means permits the top edge of the closure to rock away from the sealing gasket for sliding movement of the closure.

* * * * *